US006345458B1

(12) United States Patent
Garibian

(10) Patent No.: US 6,345,458 B1
(45) Date of Patent: Feb. 12, 2002

(54) ROTATING PUBLIC INFORMATION DISPLAY DEVICE

(76) Inventor: Roudolf Garibian, 1018 E. Hawaii Pl., Denver, CO (US) 80231

( * ) Notice: Subject to any disclaimer, the term of this patent is extended or adjusted under 35 U.S.C. 154(b) by 0 days.

(21) Appl. No.: 09/028,027

(22) Filed: Feb. 24, 1998

(51) Int. Cl.[7] ..... G09F 15/00
(52) U.S. Cl. ..... 40/506; 40/607
(58) Field of Search ..... 40/506, 607, 507

(56) References Cited

U.S. PATENT DOCUMENTS

| | | | |
|---|---|---|---|
| 1,637,988 | A | 8/1927 | Egan |
| 2,507,875 | A | 5/1950 | Williams |
| 2,514,814 | A | 7/1950 | Towne |
| 2,539,546 | A | 1/1951 | McGuire |
| 2,759,281 | A | 8/1956 | Akers |
| 3,313,560 | A | 4/1967 | Machi |
| 3,947,987 | A | 4/1976 | Allen |
| 3,986,284 | A | 10/1976 | Plantinga |
| 4,019,269 | A | 4/1977 | Vix |
| 4,118,082 | A | 10/1978 | Hoop |
| 4,164,084 | A | 8/1979 | Crockett |
| 4,329,801 | A | 5/1982 | Clausen |
| 4,353,179 | A | 10/1982 | Jennings |
| 4,454,671 | A | 6/1984 | Morgenstern |
| 4,776,116 | A | 10/1988 | Shuman |
| D305,778 | S | 1/1990 | Caulk |
| 5,054,219 | A | 10/1991 | Hoyt et al. |
| 5,245,772 | A | 9/1993 | Girardot |
| 5,572,816 | A | 11/1996 | Anderson, Jr. et al. |

*Primary Examiner*—Cassandra H. Davis
(74) *Attorney, Agent, or Firm*—Greenlee, Winner and Sullivan, P.C.

(57) ABSTRACT

A rotatable outdoor public information display device is provided for displaying bus schedules, advertising and the like, adaptable for mounting on an existing pole. The device comprises dome-shaped top and bottom caps and a main cylinder and is rotatable on lock plates fixedly attached to the pole.

11 Claims, 5 Drawing Sheets

ROTATING PUBLIC INFORMATION DISPLAY DEVICE

Rotating display devices are usefull when mounted on poles or walls to provide schedules for buses stopping near the mounted display device, for advertisements, maps and other information useful to the public.

A number of designs for rotating signs are been described in prior patents. U.S. Pat. No. 1,637,988 describes a motorized sign comprising a cylinder top and bottom ball bearings for hanging on brackets. U.S. Pat. No. 3,313,56 discloses a rotating sign device with a light inside equipped with a coil spring and designed to rotate in a single direction. U.S. Pat. No. 3,947,987 describes a rotating box on a stand. U.S. Pat. No. 3,986,284 describes a rotating kiosk. U.S. Pat. No. 4,353,179 describes a rotatable sign having rectangular panels arranged in a triangular configuration, and capable of being rotated by the wind. U.S. Pat. No. 4,776,116 describes a rotational support for a conventional flat advertising poster. U.S. Pat. Des. 305,778 discloses a three-vaned carousel on a small stand. U.S. Pat. No. 5,054,219 describes a motor-driven multi-faced sign for mounting on existing sign pedestals. U.S. Pat. No. 5,245,772 describes a triangular arrangement of rectangular panels capable of rotating on a pole. U.S. Pat. No. 5,572,816 describes a cylindrical rotating sign device having a changeable surface made of louvers. These designs do not appear to provide the type of weatherproof and tamperproof shape or construction required for an outdoor sign available to be touched and manipulated by the public without supervision.

Rotating signs designed for outdoor, public use have also been described. U.S. Pat. No. 3,986,284 describes a prismatic structure which may be attached to an existing signpost and rotated. U.S. Pat. No. 4,329,801 describes a timetable holder comprising a transparent tube which appears to fit closely around a signpost and may be rotated in grooves in a set of sleeves. U.S. Pat. No. 4,454,671 discloses a similar cylinder made in vertical sections, rotatable in a fixed track around a post. The structure is not enclosed. U.S. Pat. No. 5,116,204 describes an enclosed, rotatable domed structure suitable for mounting on an existing pole to display bus schedules and advertising; however this device has a number of drawbacks. It is difficult and inefficient to assemble, requiring placement of numerous bolts and screws. The many holes required allow dust and dirt to enter the interior of the carousel. Due to the placement of its bearings, this previously-known carousel display device has a tendency to wobble. The two-piece construction of the display device described in said patent requires a vertical seam between the pieces, interfering with the ability of sheets of advertising or notices to lie smoothly on the circumference of the carousel, or providing space for only two large sheets of advertising or notices, and the vertical seam may be easily pried apart by vandals. Further, strips of vinyl used for strip signs are deformed over the spots where the bolts used in assembling the display device are placed. This device is also manufactured by a process which forms sprues on the outer surfaces, thus requiring an extra sprue-removal step.

It is an object of this invention to provide a rotating display device which overcomes the foregoing disadvantages, which may be made by modern injection molding technologies for mass production, provides ease and efficiency of assembly, no bolts, holes or seams beneath the vinyl display sheets, improved stability of rotation, efficient manufacture and ease of poster installation, and formed so as to be maximally tamper-resistant.

SUMMARY

A rotatable outdoor public information display device is provided which is adaptable for mounting on a support which can be a pole or a set of upper and lower brackets or beams. The device is cylindrical in form, and designed to be secured to a pole inserted into it, or a pipe or other internal support inserted at least partway into the top and bottom thereof attached to brackets or beams affixed to a nearby vertical supporting structure such as a wall. The device comprises:

upper and lower lock plates fixedly attachable to a support, said upper and lower lock plates comprising means for accommodating rotation of the remainder of the device;

top and bottom caps rotatably aligned with said upper and lower lock plates respectively;

a main cylinder comprising poster display spaces removably engageable with said top and bottom caps.

Preferably, the device is designed for manual rotation by the user to view posters affixed around the circumference thereof, although other means of rotation known to the art may also be used. The pole may be an existing sign pole, a light or telephone pole, or a pole included as part of the device. The device may also be attached to brackets or beams holding it spaced apart from existing vertical supporting structure such as a wall or post, said beams or brackets being equipped with internal support members extending at least partway into the top and bottom of the device. The upper and lower lock plates fit around the pole or other support member, e.g. by threading thereon, and are fixedly attachable thereto, e.g. by means of bolt holes in the lock plates. Corresponding holes in the pole or other support member are provided. Preferably, a single bolt hole pierces each lock plate so that it may be attached to the pole or support member with a single bolt secured with a nut. Other means for attaching the lock plates to the pole or other internal support member as known to the art may also be used.

The upper and lower lock plates are preferably made of metal or other strong material including strong plastics known to the art, and comprise means for accommodating rotation of the remainder of the device. Such means include grooves sized to receive therein means on the top and bottom caps for accommodating rotation such as attached ball bearings which can revolve in the groove of the lock plate, or a slider which slides in said groove. Alternatively, the top and bottom caps may be equipped with such grooves, and the lock plates may have attached ball bearings or sliders. Preferably, the upper and lower lock plates are identical.

The top and bottom caps are also preferably identical, preferably sloped or domed to help make the device weatherproof and tamperproof When the lock plates are in place with the means for accommodating rotation thereof engaged or aligned with the corresponding means for accommodating rotation on the top and bottom caps, ideally, any gap between the lock plates and the top and bottom caps will be minimal. Rotatable alignment of the lock plates with the top and bottom caps means that complementary means for accommodating rotation on the lock plates and caps, e.g. grooves and ball bearings or sliders fitting into said grooves, are touching or engaged so that the caps rotate with respect to the fixed lock plates. The ball bearings are seated in the cap (or if the cap contains the groove, the ball bearings are seated in the lock plate), preferably the ball bearings are rotationally seated so that they can rotate but not move around the circumference of the device. At least three or four ball bearings should be used, preferably four, and any number up to the number required to entirely fill the groove, may be used. In the latter case, it is not necessary to provide means to prevent the balls from traveling around the circumference of the component in which they are seated.

The top and bottom caps may be equipped with integral circumferential ridges defining display spaces for strip posters, e.g. posters about 2"×32". The diameter of the main cylinder is preferably about 32".

The main cylinder is designed to provide display space for affixing posters such as rectangular posters of about 10"× 15". Preferably, the main cylinder is equipped with at least one integral vertical ridge to define two poster display spaces. Additional vertical ridges, as well as horizontal ridges may be provided on the main cylinder to define smaller poster display spaces. The main cylinder may be comprised of separable components, such as three or more cylindrical pieces which fit together.

The main cylinder mates with the top and bottom caps, preferably by means of a rim extending from the outer surface of the top and bottom caps, fitting over a rim extending from the inner surface of the main cylinder. Alternatively, the position of the rims may be reversed so that the caps fit into the cylinder rather than the cylinder fitting into the caps. Preferably, the caps and cylinder are removably engageable with each other so that the device may be easily taken apart for servicing of lighting inside, or for efficient changing of the poster displays by changing the entire cylinder, in the field. In this way, cylinders having outdated posters affixed thereto can be replaced and the old cylinders taken to the factory or other indoor environment for removal of the posters and affixation of new posters in a clean, non-dusty environment where heat guns and other equipment optimal for changing the posters is readily available.

It is preferred that the main cylinder be non-rotatably engageable with the top and bottom caps. Latching means may be provided as known to the art, such as springy flanges extending from the interior of the caps or cylinder having projections which snap into place in corresponding depressions formed as an integral part of the opposite member. Other latching means known to the art for prevention of relative rotation of the parts may also be used.

When the main cylinder is comprised of several cylindrical components, the components are preferably designed to fit together by the same means as used to engage the top and bottom caps with the cylinder, i.e. mating rims and latching means.

The interior of the device is hollow and may accommodate a light source, such as a fluorescent tube, and associated circuitry as known to the art to illuminate the device from within.

The display spaces of the main cylinder are preferably made of a transparent material to allow light to shine through. Posters themselves are preferably made of a vinyl or other waterproof material with adhesive backing.

The devices of this invention may be part of a system also comprising a solar-powered lamp affixed in a container also preferably containing a solar battery above the device so as to cast light on the device. Alternatively, a solar battery in such a container may be used to power a light source inside the device itself. Wires required for powering a light source inside the device may be threaded into the pole itself, when a pole is present, or grooves or holes may be cut in the lock plates to accommodate the wires. It is preferred that no holes to accommodate wires or bolts or other components be made in the display spaces of the device.

The top and bottom caps and main cylinder are preferably formed by casting or molding, preferably by injection molding using molds which do not cause formation of sprues on the outer surfaces of the device. It is preferred that the outer surfaces be completely smooth and that any sprues formed in the molding process be formed on the surfaces defining the interior of the assembled device. The bearing seats for the ball bearings and the horizontal and vertical ridges defining the display spaces are preferably formed integrally with the caps and cylinder in the molding process. Ball bearing retainers known to the art may be placed over the ball bearing seats. The mating rims and latching means are also preferably integrally formed during molding.

The components are quickly and easily manufactured and assembled. Display posters may be affixed to the display spaces by means known to the art, preferably by using posters having an adhesive backing which sticks to the outer surface of the device. Such posters are preferably removable by use of heat. The posters are preferably attached to the cylinders either in the factory or other clean indoor location. They may also be attached in the field. After assembly of the components and affixation of the posters, the device may be affixed to the outdoor support. As will be understood in the art, the foregoing steps may be performed in any order desired, e.g. the components may be partially or completely assembled in the field.

When a member of the public desires to view the information on the posters affixed to the device, he can easily rotate the device by hand to view all sides of the device.

The devices of this invention are inexpensive and easy to manufacture and assemble, and can be mass-produced by modern injection molding techniques with a minimum number of different components. They provide completely smooth display spaces without holes, projections or scars for affixing posters. The enclosed design makes the device weather-resistant and the horizontal joints between components provide much greater resistance to would-be vandals than the long vertical seams of prior art devices which lend themselves to being pried apart. The simple rotational means provided at the top and bottom provide improved stability of rotation, and the shape and rotational qualities of the device are aesthetically pleasing and user-friendly.

DETAILED DESCRIPTION

Figure 1:
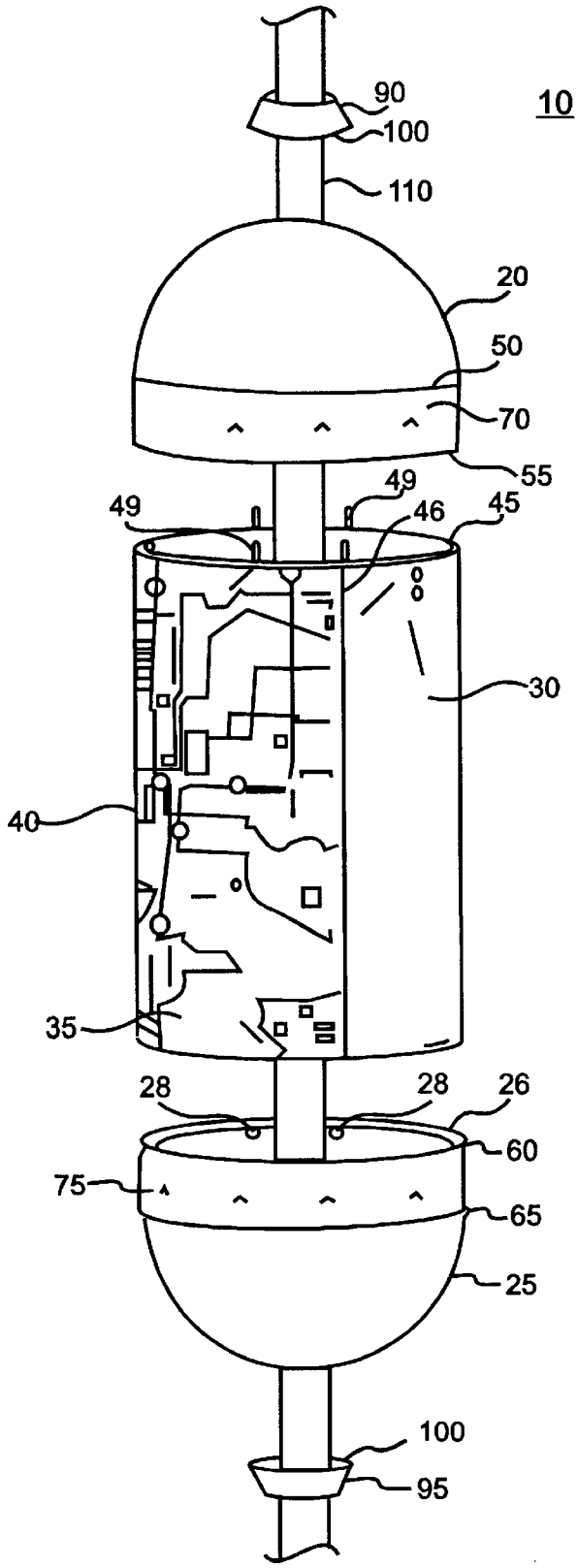
FIG. 1 is a side view of the device showing separate components spaced apart from each other and threaded on a central pole.

FIG. 1 shows the main annular components of the display device 10 threaded on a post 110 in the order in which they are to be assembled. The display device 10 comprises an upper lock plate 90, which is preferably identical to lower lock plate 95, grooved to hold ball bearings 100. The lock plates 90 and 95 are ring shaped and may have different inner diameters designed to accommodate round posts having varying diameters and square posts having varying diagonal dimensions. The sides of upper and lower lock plates 90 and 95 may be straight, or they may be angled as shown in FIG. 1. Top cap 20 is equipped with top cap ridge 50, preferably molded as an integral part thereof, extending outward a short distance, e.g. 3–4 cm, and having a width of preferably about 10–12 cm, and similar top cap edge ridge 55 which define top strip poster display space 70 in which a standard size strip poster or decorative material can be displayed. Strip poster display space 70 is preferably about 2" in width and about 32" in diameter. Top cap 20 and bottom cap 25 are preferably domed to resist dust and weather and comprise a cap rim 26 extending from the outer surface of the medial edge of the cap designed as female coupling means with main cylinder 40. Main cylinder 40 is equipped at the top and bottom with cylinder rims 45 extending from the inner surface thereof designed as male coupling means for inserting into of cap rims 26. Main cylinder 40 may also, if desired, be equipped with latches 49 which are flanges extending from cylinder rims 45 designed to engage with latch grooves 28 on the inner surfaces of top and bottom caps 20 and 25. The term "medial" as used herein means toward the center of the device. The term "distal" means toward the ends of the device. Main cylinder 40 may also be equipped with one or more vertical ridges 46 defining at least first poster display space 30 and second poster display space 35 shown in FIG. 1 as having maps displayed therein. Posters, which are typically made of vinyl or other weather resistant material, are preferably adhesively applied to the outer surface of main cylinder 40 and have a size of about 10" by 15". Bottom cap 25 is equipped with bottom cap ridge 60 and bottom cap edge ridge 65 defining bottom strip display space 75. These ridges and display spaces are preferably identical to those on top cap 20.

Figure 5:
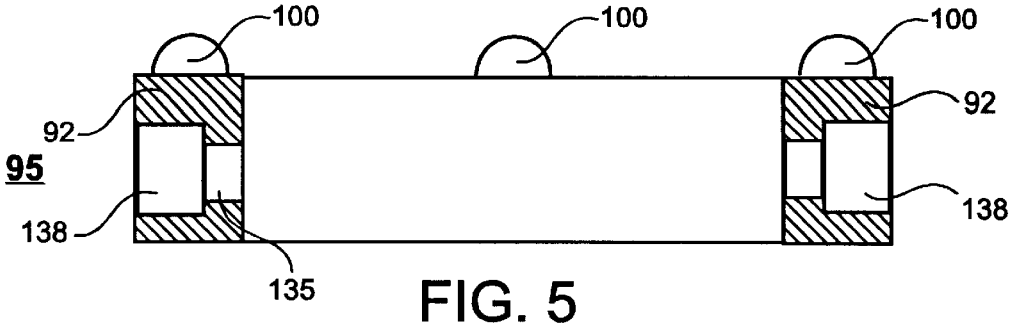
FIG. 5 is a cross-section of the lower lock plate taken along line 5—5 of FIG. 4.
Figure 6:
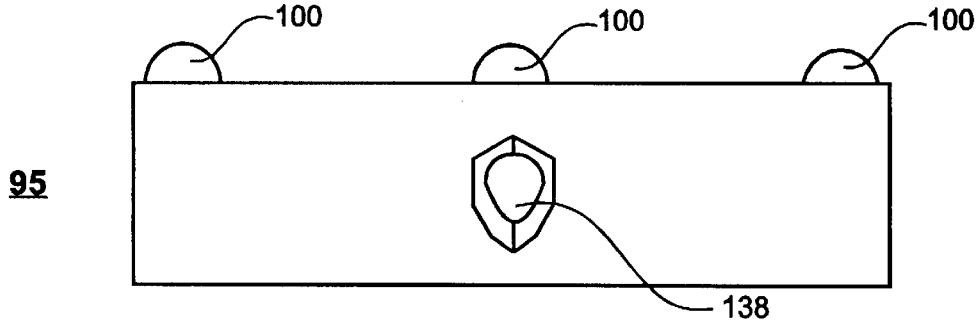
FIG. 6 is a side view of the lower lock plate.

To assemble the device, the components are threaded in order up on a pole and fitted together, preferably without the use of bolts and threaded on a pole or other internal support member. Bolts are preferably used only to secure upper and lower lock plates 90 and 95 to the support, e.g. pole 110 as shown in FIGS. 4–6.

Figure 2:
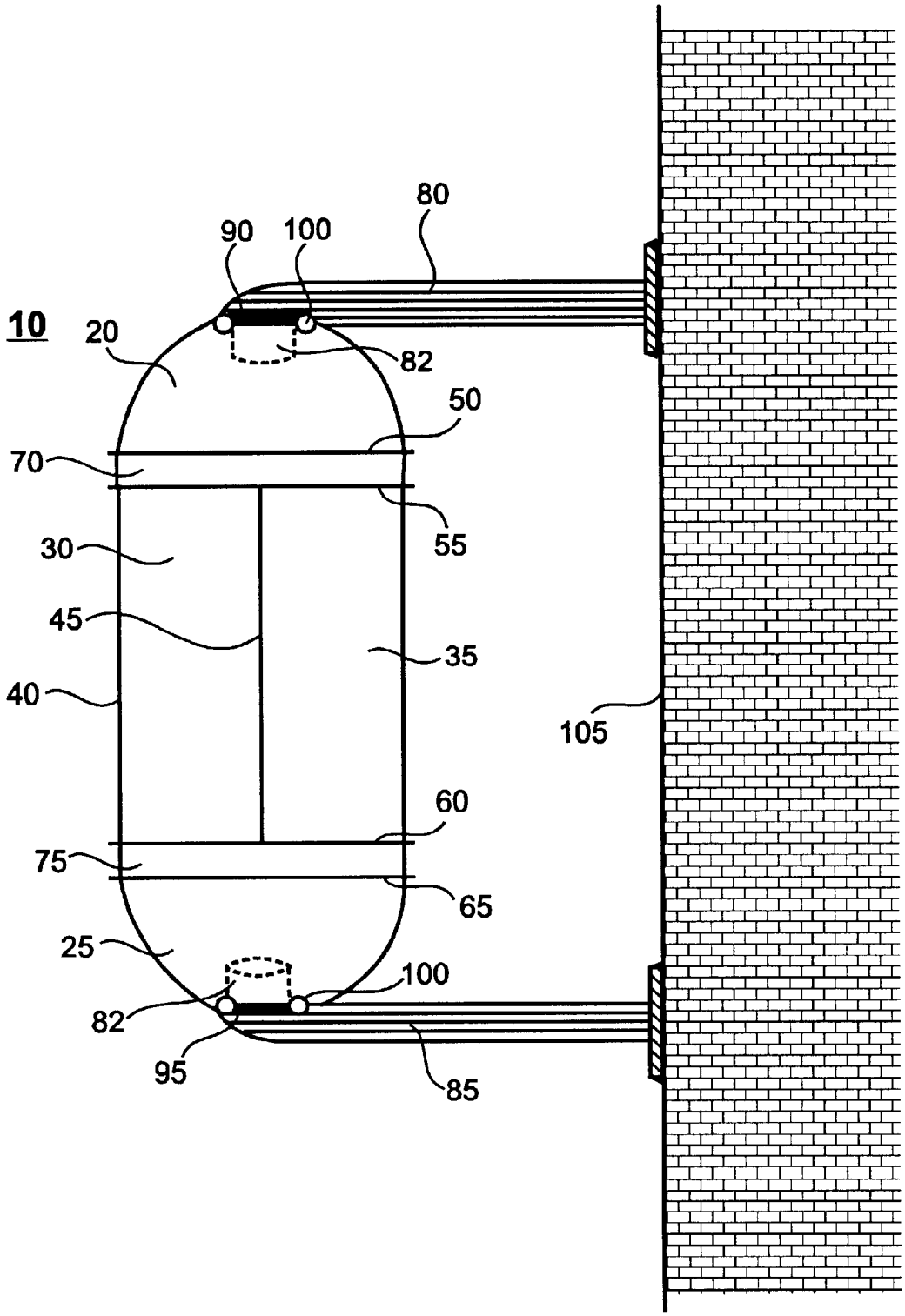
FIG. 2 is a side view of the device mounted on support beams.

FIG. 2 shows the annular components described above with respect to FIG. 1 supported on upper support beam 80 and lower support beam 85. No pole is required, however an internal support member such as pipe section 82, which may be an integral part of support beams 80 and 85, is provided for bolting to upper and lower lock plates 90 and 95. The support beams are attached to vertical supports such as wall 105. The vertical support for the upper and lower support beams 80 and 85 may be the same or different as suited to the location where the device is to be placed.

Figure 3:
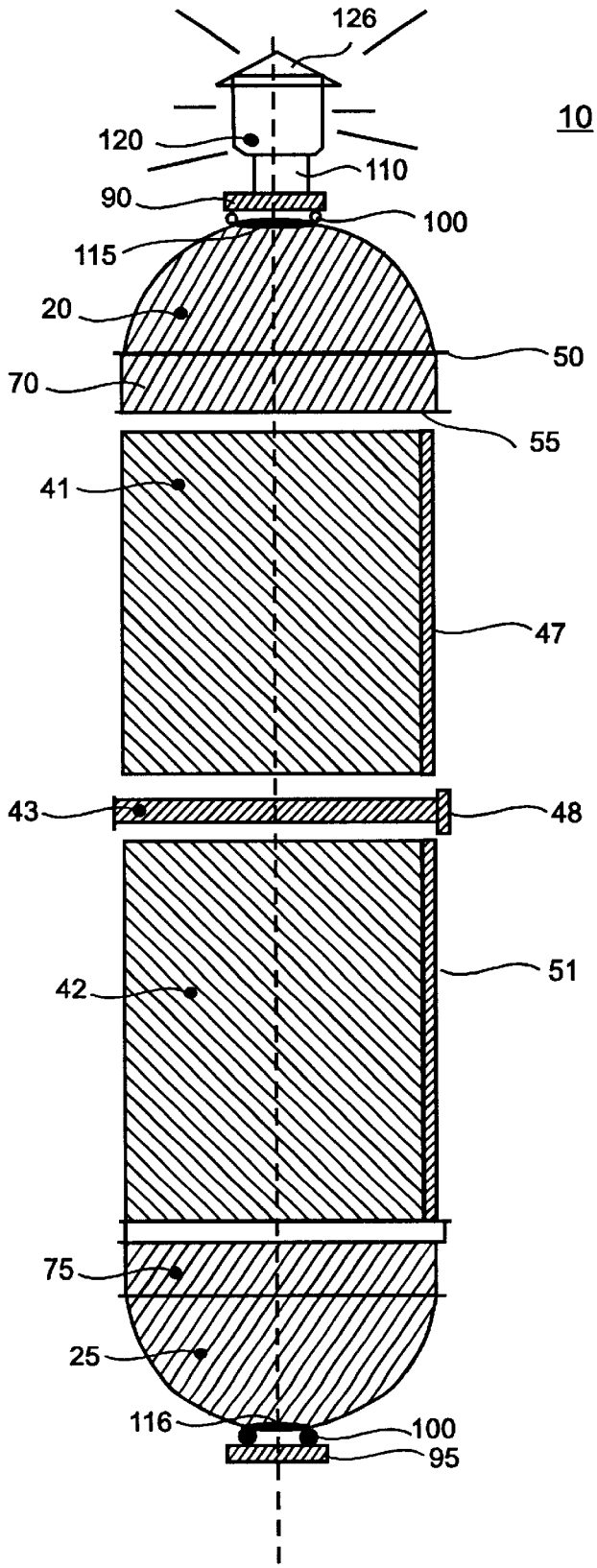
FIG. 3 shows another embodiment of the device in which the main cylinder is comprised of separable components, in combination with a lamp and battery container.

FIG. 3 shows another embodiment of the device with the components spaced apart from each other which includes a housing or container 120 for a lamp and optimally a solar battery which may be used to power a lamp inside the housing or placed inside the main cylinder as is known to the art. In this embodiment, the main cylinder is comprised of an upper cylinder 41 on which vertical ridge 47 can be seen, a lower cylinder 42 on which vertical ridge 51 can be seen, and a middle cylinder section 43 on which vertical ridge 48 can be seen. In this embodiment, the components of the main cylinder are equipped with mating means (not shown), preferably an outer rim on the edges of upper and lower cylinders 41 and 42 similar to those on top and bottom caps 20 and 25 mating with an inner rim on middle cylinder section 43. Vertical ridges 47, 48 and 51 are preferably lined up to form a continuous vertical ridge when the parts are assembled. Top and bottom holes 115 and 116 of top and bottom caps 20 and 25 respectively are shown in this view, as though the top and bottom caps 20 and 25 were slightly tilted to make the holes visible.

Figure 4:
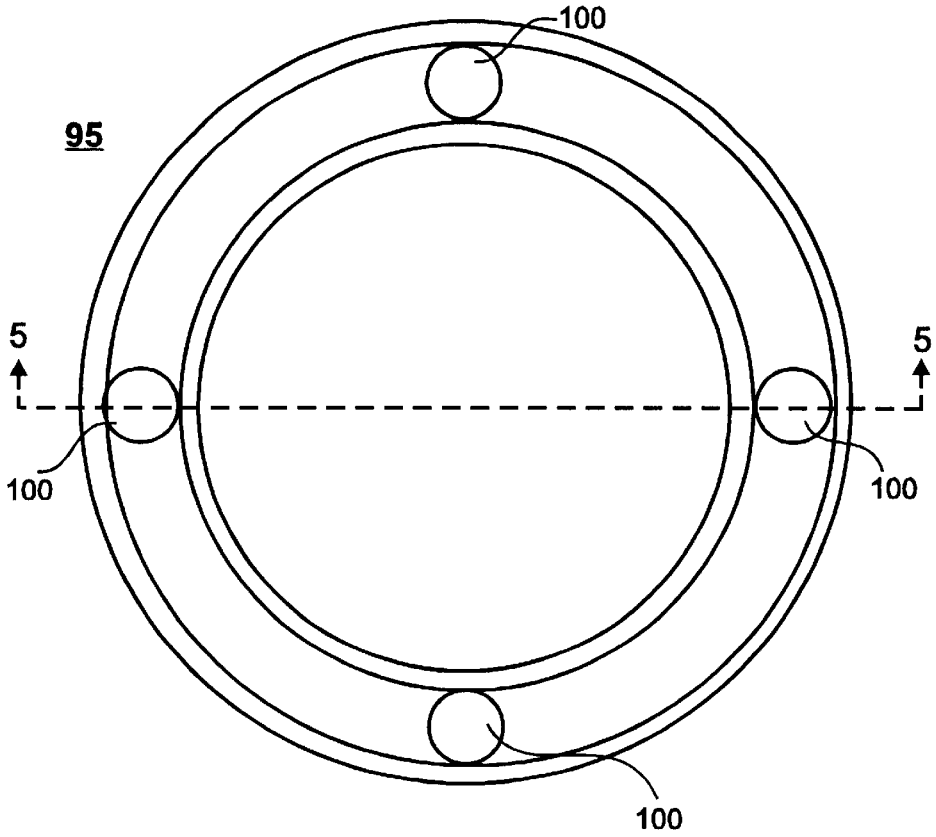
FIG. 4 is a top view of the lower lock plate showing a groove for ball bearings.
Figure 8:
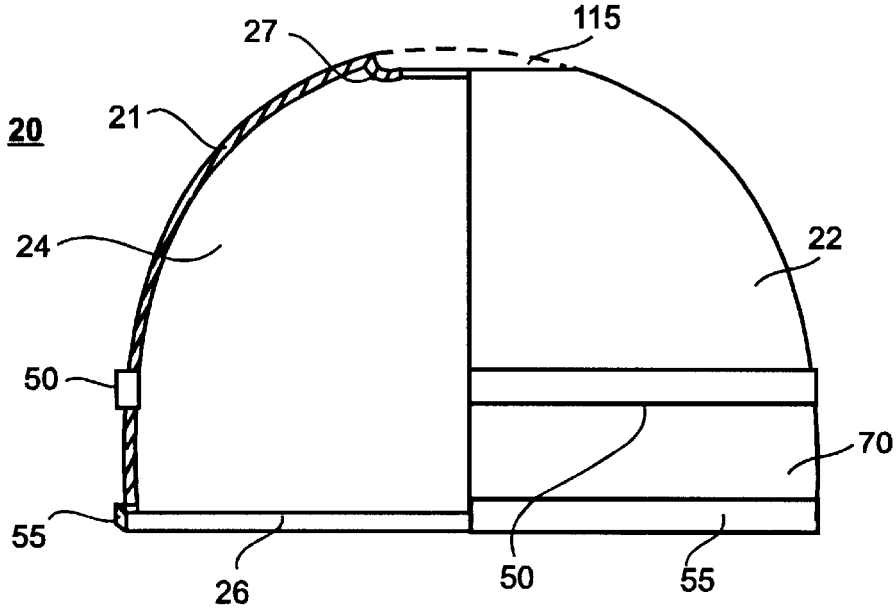
FIG. 8 is a side view of the top cap with a 90° front left segment cut away to reveal the inside of the cap.

FIG. 4 is a top view of the lower lock plate 95 which is preferably identical to upper lock plate 90. The lower lock plate 95 preferably has an inner diameter large enough to accommodate a standard city sign pole, e.g. about 40–100 cm, and an outer diameter preferably designed to correspond to the outer diameter of bottom hole 116. Lock plate 95 also comprises a bearing groove 92 around which ball bearings 100 may freely move. It will be understood in the art that lock plate 95 may be of any size required so long as the size of bearing groove 92 is sized to accommodate bearings 100 held in bearing seats 27 of bottom cap 25 as shown in FIG. 8.

FIG. 5 is a cross-section of lower lock plate 95 taken along line 5—5 of FIG. 4, showing ball bearings 100 in bearing grooves 92 and bolt hole 138 for receiving a bolt extending through the entire lock plate, said bolt hole 138 being expanded at its ends to accommodate a bolt having a head on one end and being threaded into a nut on the other.

FIG. 6 is a side view of lower lock plate 95 showing ball bearings 100 and bolt hole 138.

Figure 7:
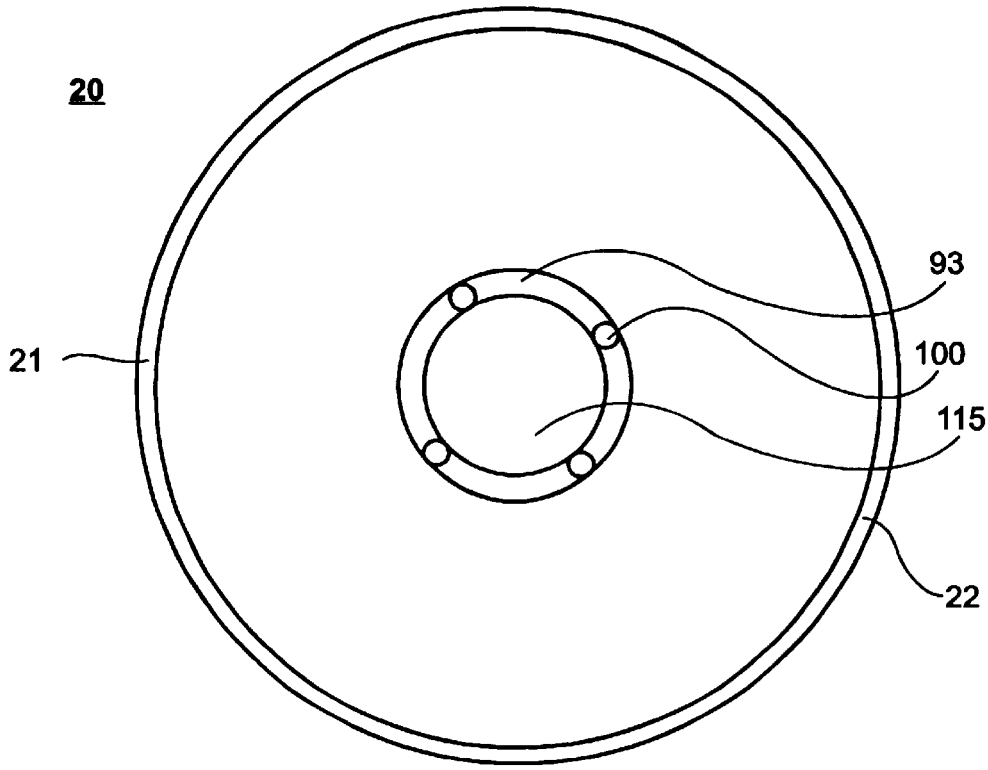
FIG. 7 is a top view of the top cap showing placement of the ball bearings.

FIG. 7 is a top view of top cap 20 showing outer cap wall 21, ball bearings 100, bearing retainer 93, top cap hole 115 and outer cap surface 22. Although four ball bearings 100 are shown, as is known to the art any number of ball bearings, up to and including a number sufficient to fill bearing groove 92 of upper lock plate 90, with which top cap 20 engages, may be used. The bearings are retained so that they may rotate in place on top cap 20 as is known to the art, e.g. by means of bearing retainer 93 and bearing seat 27 (FIG. 8).

FIG. 8 is a side view of top cap 20 with a 90° front left segment cut away to show the inside of the cap. Top hole 115 is shown as though the component were tilted slightly forward. Bearing seat 27, preferably formed as an integral part of outer cap wall 21, is designed to hold a ball bearing in place. Inner cap surface 24 is visible on the left side of the figure as is the edge of top cap ridge 50 and top cap edge ridge 55. On the right side of the figure smooth outer cap surface 22 can be seen as well as top cap ridge 50 and top cap edge ridge 55 defining top ridge display space 70. The outer surfaces of top and bottom caps 20 and 25 as well as main cylinder 40 are smooth and without holes or spines or scars where sprues have been removed.

To assemble the device, bottom cap 25 is lowered onto lower lock plate 95 so that ball bearings 100 fit into ball bearing groove 92 and are freely movable therein. Main cylinder 40 (or the components thereof in embodiments where separate components are provided) is mated into bottom cap 25 with cap rim 26 overlying lower cylinder rim 45. Top cap 20 is then lowered onto main cylinder 40 so that cap rim 26 overlies upper cylinder rim 45. Upper lock plate 90 is positioned so that bearing groove 92 covers ball bearings 100 in bearing seats 27 of top cap 20, and allows the bearings to rotate freely in said bearing seat and around said groove. As will be understood by those skilled in the art, the device may also be assembled in reverse order or in any other convenient order. Preferably the device is assembled in the factory where a clean environment is available for attaching the posters, then taken to the field where it can be bolted to supports in three to five minutes.

In use, the device is placed at a convenient level for viewing by pedestrians or motorists, and it is freely and easily rotatable by hand to display the posters on all sides.

Seamless display spaces without bumps or holes are provided, and the domed tops and bottom readily resist rain, snow and dust. Long vertical seams which provide easy access to vandals are eliminated.

The components of the device are easily and inexpensively fabricated using injection molding techniques known to the art. The main cylinder is preferably made of transparent material, and lights are placed inside to illuminate the posters from within. The top and bottom caps are preferably made of opaque material, e.g. having a woodgrain, brass, or other decorative finish, and may be made with transparent display strips if desired. The upper and lower lock plates are preferably metal or strong plastic components. The ball bearings are preferably metal.

It will be understood that modifications can be made in the embodiments of the invention illustrated and described herein without department from the scope and purview of the invention as defined by the appended claims.

What is claimed is:

1. A rotatable outdoor public information display device adaptable for mounting on a pole or bracket support insertable into said device, comprising:

upper and lower lock plates fixedly attachable to said support, said upper and lower lock plates comprising means for accommodating rotation of the remainder of the device;

identical dome-shaped top and bottom caps, comprising means for accommodating rotation of the device complementary to those on the upper and lower lock plates, rotatably aligned, respectively, with said upper and lower lock plates;

wherein said top and bottom caps comprise integral circumferential ridges defining strip display spaces; and a main cylinder mating with said top and bottom caps comprising poster display spaces removably engageable with said top and bottom caps.

2. The device of claim 1 wherein said means comprised in said lock plates for accommodating rotation of the remainder of the device comprise a groove sized to permit revolving of ball bearings seated within said top and bottom caps.

3. The device of claim 1 wherein said main cylinder is non-rotatably engageable with said top and bottom caps.

4. The device of claim 1 wherein said lock plates are attached to said support by means of a single bolt extending through each lock plate and said support.

5. The device of claim 1 comprising a light source in the interior thereof.

6. The device of claim 1 wherein said upper and lower lock plates are identical.

7. The device of claim 1 wherein said top and bottom caps comprise rims extending from the outer surfaces thereof and said main cylinder comprises rims extending from the inner surfaces thereof whereby said top and bottom caps are engageable with said main cylinder.

8. The device of claim 1 wherein said top and bottom caps comprise and said main cylinder comprises complementary latching means, whereby said top and bottom caps are latchably engageable with said main cylinder.

9. The device of claim 1 wherein said main cylinder comprises three cylindrical sections engageable with each other.

10. The device of claim 1 wherein said main cylinder comprises an integral longitudinal ridge.

11. An outdoor sign system comprising the rotatable device of claim 1 and a solar-powered lamp affixed thereabove for illuminating said device.

* * * * *